US005516170A

United States Patent [19]

Kruskamp

[11] Patent Number: 5,516,170

[45] Date of Patent: May 14, 1996

[54] APPARATUS AND METHOD FOR INSTALLING CARPET AND VINYL FLOOR COVERING

[75] Inventor: Stephen L. Kruskamp, Fair Oaks, Calif.

[73] Assignee: Gary K. Wood, Carmichael, Calif.; a part interest

[21] Appl. No.: 376,978

[22] Filed: Jan. 23, 1995

[51] Int. Cl.[6] ..... A47G 27/04

[52] U.S. Cl. ..... 294/8.6; 254/200

[58] Field of Search ..... 294/8.6; 254/200, 254/209, 211, 212

[56] References Cited

U.S. PATENT DOCUMENTS

| | | | |
|---|---|---|---|
| 46,882 | 3/1865 | Collier | 294/8.6 |
| D. 209,620 | 12/1967 | Kochanowski . | |
| 317,296 | 5/1885 | Carter | 254/209 |
| 388,864 | 9/1888 | Hall | 254/212 |
| 639,718 | 12/1899 | Dexter | 254/212 |
| 755,960 | 3/1904 | Strader | 294/8.6 |
| 809,545 | 1/1906 | Wever | 254/209 |
| 844,107 | 2/1907 | Driver . | |
| 1,919,840 | 7/1933 | Hoobler . | |
| 2,631,403 | 3/1953 | Hopkins . | |
| 2,882,642 | 4/1959 | Hill . | |
| 3,359,032 | 12/1967 | Kochanowski | 294/8.6 |
| 3,374,023 | 3/1968 | Hill et al. . | |
| 3,556,479 | 1/1971 | Palachuck | 254/200 |
| 3,866,964 | 2/1975 | Prater . | |
| 5,129,696 | 7/1992 | Underwood | 294/8.6 |

*Primary Examiner*—Dean Kramer
*Attorney, Agent, or Firm*—Lothrop & West

[57] ABSTRACT

An apparatus and method for installing floor covering. The present invention provides a floor-engaging roller to the rear portion of a "kicker", used in the trade to install floor covering. The roller vertically spaces the rear, knee-butting portion of the kicker from the floor, and maintains the forward head portion in proper position, so it more effectively engages the floor covering. The roller also provides significantly reduced friction in forward movement of the kicker, reducing the work effort of the installer. Interchangeable face plates on the head of the kicker allow it to be used both on carpet and on vinyl floor coverings. A complete, new kicker and structures for modifying existing kickers in accordance therewith, and methods for using same, are disclosed.

26 Claims, 8 Drawing Sheets

APPARATUS AND METHOD FOR INSTALLING CARPET AND VINYL FLOOR COVERING

CROSS REFERENCE TO RELATED APPLICATIONS

The applicant herein is the named inventor of design patent application Ser. No. 29/077,011, filed Apr. 14, 1993, for a Vinyl And Carpet Kicker.

FIELD OF THE INVENTION

The invention pertains to tools and methods used to install floor covering, including both carpet and vinyl floor covering. More specifically, the invention relates to modifications and improvements to carpet "kicker" tools, used by floor covering installers. Use of the invention herein ensures that both carpet and vinyl floor covering can properly be stretched, located, and positioned during the installation process.

BACKGROUND OF THE INVENTION

Large pieces of floor covering, whether they be cut from carpet or vinyl material, are difficult to manipulate into position, for proper installation. Various tools have been developed and refined over the years to assist in the installation of these flooring materials.

A device commonly used in the trade for installing carpet is known as a "kicker". A typical kicker includes an elongated body having a forwardly-positioned head portion, with downwardly directed teeth or spikes for engaging the carpet. A rearwardly-positioned knee pad is successively butted by the installer's knee, to stretch the carpet, and urge it forwardly into proper position over peripherally located, carpet tack strips.

One of the problems with prior art carpet kickers is the excessive friction which is developed, between the rearward end of the kicker, including the lower edge of the knee pad, and the underlying carpet. This friction is especially troublesome if the carpet is thick, and the installer, by habit or necessity, pushes downwardly upon the elongated shank of the kicker when butting the knee pad. Such friction must be overcome by greater exertions on the part of the installer, and cumulatively, the friction slows the installation process.

Another drawback of such prior art kickers is the relatively low position of the knee pad, with respect to the knee of the installer. This low position makes it more difficult for the installer to apply effective butting forces against the knee pad, and forces the installer solely to use his knee as a butting instrument, rather than a portion of his upper leg.

Moreover, owing to their construction, prior art carpet kickers are not adapted for use on other types of floor covering, such as vinyl flooring. The head of a conventional carpet kicker does not have a lower face adapted to engage the smooth surface of vinyl flooring. Also, the lower edge of the kicker's knee pad, or any associated metal skid plate, tends to scuff and abrade the vinyl surface.

Vinyl flooring has its own unique characteristics which are quite different from carpet, and these characteristics pose different problems for installation. In preparation for installation, a vinyl sheet is precut to fit a particular floor area. Thereafter, the installer applies a predetermined amount of adhesive to the subject floor area, in a pattern appropriate for the vinyl material to be installed.

After the vinyl sheet is laid over the adhesive and downwardly compressed, bubbles or ripples may still exist in the floor's surface. Installers typically use a downward rolling pressure, applied through a hand roller, in an effort to smooth out these surface anomalies. However, once the vinyl has partially adhered to the underlying floor, it is very difficult to manipulate. Consequently, this pressure-rolling technique is not always successful, particularly with a full spread adhesive pattern. Over a period of time, any remaining bubbles or ripples will cause unsightly cracks in the flooring, and premature deterioration of the smooth surface will result.

Other problems may arise if the installer does not effect a complete bond between the undersurface of the vinyl sheet and the adhesive. Since the forces applied by the roller are primarily downward and compressive, they are not effective to tighten the vinyl, by slightly shifting or translating the sheet across the underlying adhesive. As a consequence, an uneven or partial bond between the adhesive and the vinyl may be formed.

Eventually, a poor adhesive/vinyl bond will break, causing the vinyl and the underlying floor to separate, or delaminate. This problem is particularly acute in the coving portion of the floor, where a "toe kick" region under a cabinet impairs access for the installer. Limited access to the area makes it difficult for the installer to roller-apply a sufficient amount of bonding pressure.

In more modern, perimeter bonded vinyl flooring, the installer applies a narrow three or four inch swath of adhesive, only upon selected locations of the substrate. Typically, these locations include the perimeter of the flooring, and the perimeters of any vents or islands included within the flooring area.

Perimeter bonded flooring critically relies upon: (1) tightening the vinyl flooring to eliminate waves or ripples in the surface; and (2) forming an effective perimeter bond to anchor the floor in a permanent position. Currently, installers tighten and manipulate the vinyl floor into final position by leaning or pushing against walls, while standing on the floor surface. This method is awkward for the installer to implement, and can be ineffectual in smoothing out surface ripples in some installations.

The need exists, then, for a floor covering installation tool and an associated method, which are effective for the installation both of carpet and vinyl floor covering. The need also exists for retro-fit adapters, to modify existing carpet kickers for use in accordance with the teachings of the apparatus and method disclosed herein.

SUMMARY OF THE INVENTION

The invention disclosed herein includes a kicker tool adapted to install both carpet and vinyl floor coverings. The installation tool has a floor-engaging roller or wheel, to support and vertically space the rear portion of the kicker, particularly the lower edge of the knee pad and any associated structure, from the floor surface. The roller significantly reduces friction between the rear, dragging portion of the kicker and the floor. And, the lower friction commensurately reduces the work effort required of the installer. The improved kicker provides the further advantage of maintaining the head in a proper orientation, so its face more effectively engages the floor covering.

The kicker head has interchangeable face plates, one having spikes for engaging carpet, and another having a resilient, rubberized "boot", for gripping vinyl floor covering. Several designs for the rubberized "boot" portion of the face plates are disclosed. A first boot is especially adapted for flat lay applications, having a downwardly and forwardly jutting nose portion. This first boot is used when installing large or small, planar expanses of vinyl material. A second boot is designed for installing vinyl flooring in the cove regions, and includes an upwardly curving forward nose for that purpose.

Also disclosed herein are two structures for easily modifying prior art carpet kickers, in accordance with the improvements and advantages of the present invention. One such structure comprises an adapter plate, mounted between the knee pad and the shank portion of the kicker to be modified. The adapter plate includes a roller, or a wheel, on its lower portion, effective to maintain the lower edge of the knee pad in spaced relation from the floor. The second structure includes a rubberized boot, sized and configured to surround face and side aspects of the head of the existing kicker. Means is also disclosed, detachably to secure the rubber boot to the head, so that the adapter boot can selectively be attached for installing vinyl material, and removed for installing carpet.

DETAILED DESCRIPTION OF THE PREFERRED EMBODIMENT

Figure 1:
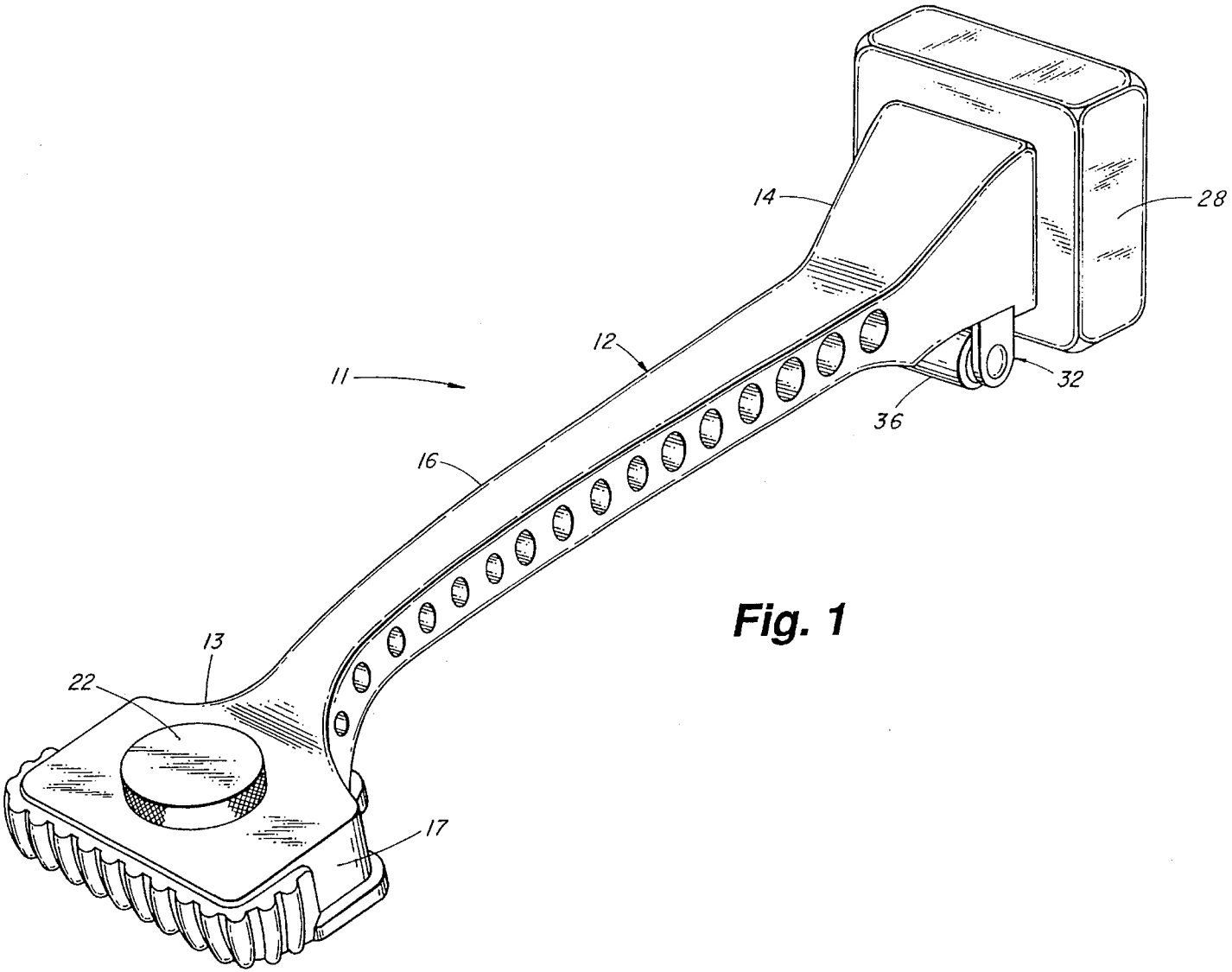
FIG. 1 is a left front perspective of the improved kicker, fitted with a face plate for installing vinyl flooring coving.
Figure 2:
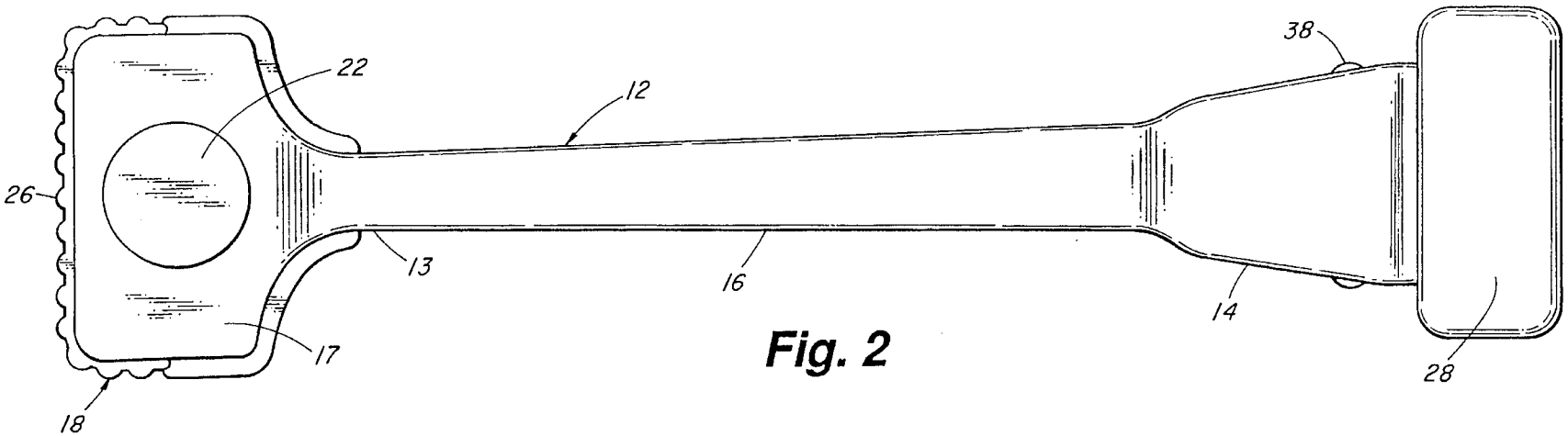
FIG. 2 is a top plan view of the kicker.
Figure 3:
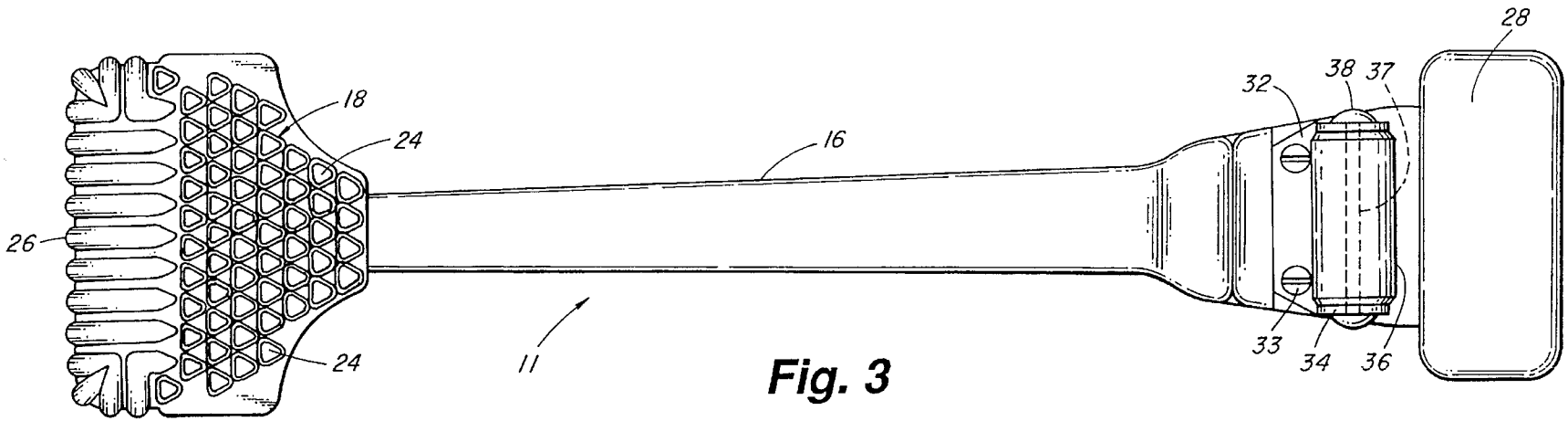
FIG. 3 is a bottom plan view of the kicker.

Turning now to FIG. 1, the carpet and vinyl floor covering tool, or kicker 11 of the present invention includes an elongated body 12 having a forward portion 13, a rearward portion 14, and a shank 16 therebetween. A kicker head 17 is provided on forward portion 13, for the purpose of engaging the floor'covering to be installed using the tool. Kicker head 17 may be used in conjunction with a number of detachable face plates, each of which is designed for a particular floor covering, or a specific application phase in the installation of vinyl floor covering.

For example, in FIGS. 1–6, a face plate 18 is adapted for the installation of coving for a vinyl floor. Face plate 18 is comprised of a metal base 19 and a resilient, rubber coving boot 21. The upper surface of base 19 is has a pattern of raised portions and recesses to mate with accommodating configurations in the lower surface of head 17. Base 19 is detachably affixed to head 17 by means of a gripable screw 22 and a threaded hole 23, recessed within the base (see FIG. 5). As will be noted herein, for each different face plate, the same base 19 is used, with only the rubberized boot or spikes, attached thereto, being changed for the required application.

Coving boot 21 includes a downwardly facing portion, having a planar array of truncated, pyramidal knobs 24, well adapted for gripping a vinyl surface. Knobs 24 present a flat surface to the floor, and have upwardly and outwardly diverging walls, as shown particularly in FIGS. 3 and 4. Boot 21 also has a forwardly and upwardly directed arcuate nose 26, including convolutions for resiliently engaging the curvature of the vinyl coving 25. In short, the material and surface configuration of boot 21 is specially adapted for gripping the vinyl surface and manipulating the vinyl into the proper configuration and location for forming the coving 25.

The elongated body, including the shank 16, may be provided with a plurality of transverse apertures 27, extending entirely through the shank. These apertures significantly reduce the weight of the tool and the effort required by the installer to lift and drive the kicker 11.

The rearward portion 14 of the tool, includes a knee pad 28 and an attachment plate 29, having a square-shaped rearward face. A generally square-shaped cavity 30 is provided in the forward face of pad 28. Cavity 30 has a rear portion which is sized and configured fully to accommodate plate 29, and a forward opening of slightly reduced size. When the attachment plate is installed within the rear portion of the cavity, the forward opening of the cavity fits snugly around rearward portion 14 of the kicker (see FIG. 1). A plurality of protuberances 31 is included on the rear face of plate 29, to improve engagement between the plate and the pad surface within cavity 30. Knee pad 28 is typically made of a relatively soft but resilient material, so that it can withstand the repeated knee butting of the installer without being so hard as to bring about injury.

A wheel bracket 32 is attached to the underside of rearward portion 14 by means of screws 33. Wheel bracket 32 has a pair of depending lateral flanges 34, rotatably supporting wheel or roller 36 by means of axle 37. Caps 38 securely retain the axle and the wheel between flanges 34. The dimensions of the bracket 32 and the wheel 36 are such that a lower edge 39 of the knee pad is maintained in vertically spaced relation above the vinyl floor covering 41 (see, FIG. 4).

This vertical spacing, combined with the low rolling resistance provided by the wheel 36, significantly reduces the overall resistance of the present invention, to being moved over any type of flooring surface. Since normal use of the tool 11 requires that the installer grips the shank 16 and press downwardly while the knee pad 28 is butted, the lower resistance to translational movement offered by the present tool construction, is particularly advantageous. Additionally, when using the present invention to install vinyl flooring, the wheel 36 does not scuff or mar the flooring's upper surface.

Figure 6:
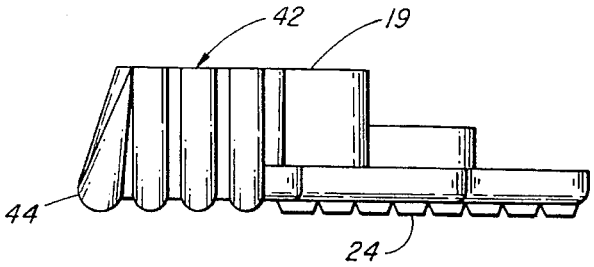
FIG. 6 is a side elevational view of a face plate for flat lay of vinyl flooring.
Figure 7:
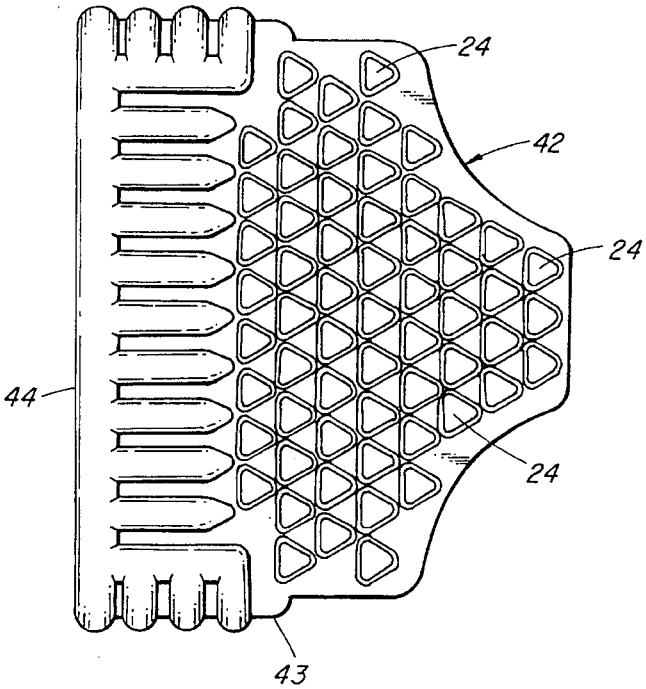
FIG. 7 is a bottom plan view of the boot shown in FIG. 6.
Figure 8:
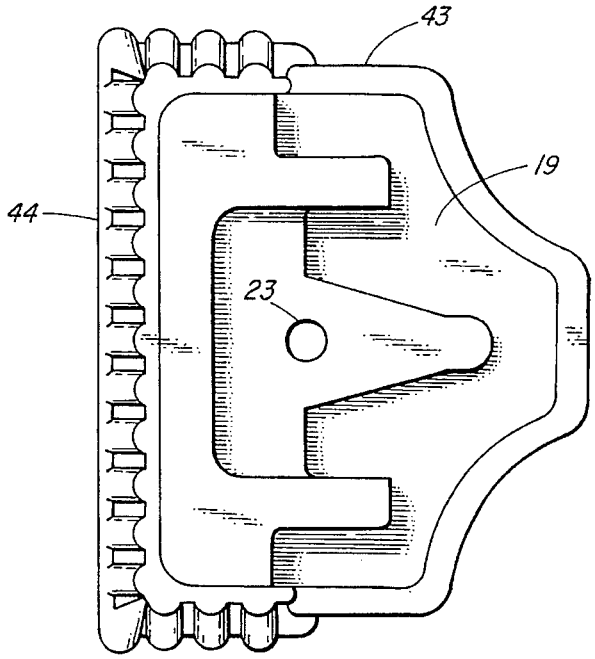
FIG. 8 is a top plan view of the boot shown in FIG. 6.

An alternative "flat lay" face plate 42, specially adapted for laying flat expanses of vinyl flooring, is also disclosed herein, and shown in FIGS. 6–8. It will be noted that the same metal base 19, used in conjunction with coving face plate 18, is used for face plate 42. This allows the two face plates to be used alternatively with gripper head 17, depending upon the stage of installing vinyl covering to the floor.

Plate 42 includes a resilient, rubber boot 43, which is faced with a plurality of downwardly directed pyramidal knobs 24. These knobs are described more fully above, in connection with the boot for coving face plate 18. Boot 43 also has a forwardly and downwardly directed jutting nose 44, designed to enhance frictional engagement between the vinyl covering 41 and the boot 43. In this way, the butting forces applied to the knee pad 28 will be transferred more effectively to the covering, over expansive, flat areas of flooring.

Having discussed some of the basic components of the kicker 11, we can now turn to an exemplary use of the present invention, in the installation of perimeter bonded vinyl floor covering.

In applying the perimeter bonding technique, a three or four inch wide band of adhesive 46 is spread, only upon certain portions of the floor 47, or substrate. These portions include the area underlying the perimeter of the individual piece, or assembled pieces, to be installed. Also, if any cutouts for islands, registers, or the like, are included within a piece, a perimeter swath of adhesive is applied to the flooring around these obstructions as well.

In the next step, the installer carefully positions the floor covering, and lowers it into contact with the adhesive. At this point, ripples, waves, or bubbles may exist in the surface of the flooring. To eliminate these surface convolutions, the floor covering itself must be tightened. At the same time, a quality perimeter bond between the covering and the adhesive must be formed, to maintain the vinyl in its tightened state for the lifetime of the floor covering.

To that end, certain translational forces must be applied to the vinyl floor covering during installation. The effective application of translational forces to the vinyl allows the installer to tighten the floor covering into a final position, while eliminating all ripples and waves in the process. These translational forces also shift portions of the vinyl sheet across the adhesive, and enhance the bond with the underlying adhesive and the floor.

Figure 4:
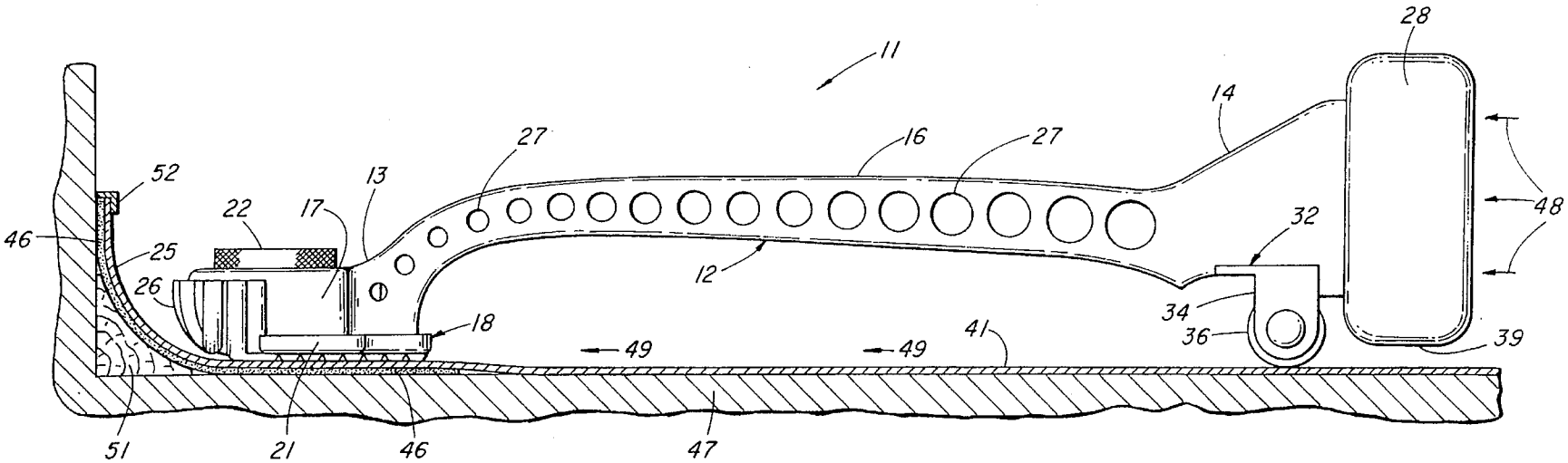
FIG. 4 is a side elevational view of the kicker, including a cross-sectional representation of planar and cove portions of a perimeter bonded, vinyl floor covering.
Figure 5:
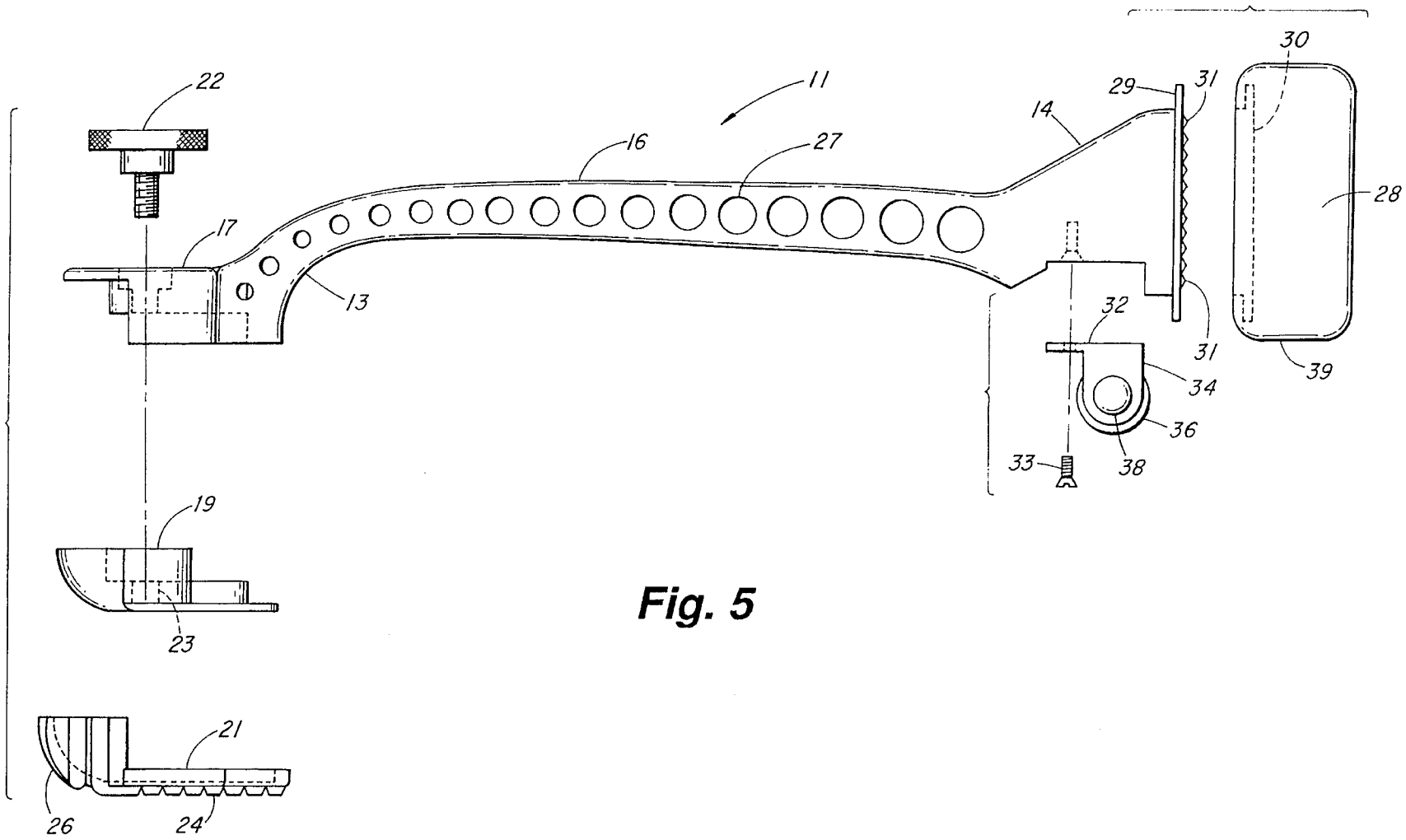
FIG. 5 is a side elevational assembly drawing of the kicker.

FIG. 4 illustrates how the present invention produces these shifting forces, in the actual process of installing a coving area of a perimeter bonded floor covering. The kicker 11, fitted with coving face plate 18, is placed over the floor covering 41, and is successively butted on the knee pad 28, by the installer. Arrows 48 represent the butting forces applied by the installer on pad 28. At the same time, the installer grips shank 16, and presses downwardly to ensure tight engagement between boot 21 and floor covering 41. The butting forces are transmitted through the body 12, and transferred to covering 41. The resultant shifting of the covering is represented by arrows 49. Successive butting of the kicker acts to translate the covering, eliminating the ripples and tightening the vinyl material.

In the area of the coving 25, butting of the kicker shifts the covering 41 over adhesive 46. Nose 26 further acts to jam the covering into tight relation with cove stick 51. The movement of the covering 41 with respect to the underlying adhesive 46, provides an enhanced bond, securing the covering in its tightened, or tensioned state. After the covering is fully tightened and bonded, a coving cap 52, is installed over the upper end of the vinyl floor covering, to complete the job.

The invention may also be used advantageously for other aspects of installing vinyl floor covering. For example, an installer may use the kicker in the initial stages of laying out flooring material for sizing, cutting, and positioning pieces. In another example, the kicker may be used to position and manipulate floor covering in a "full spread" application (not shown) of adhesive. Using this "full spread" technique, the adhesive is applied over entire sections of the floor, in stages. Portions of the vinyl covering are then carefully rolled out over the fresh adhesive, and compressed against the floor to form a tight bond.

Figure 9:
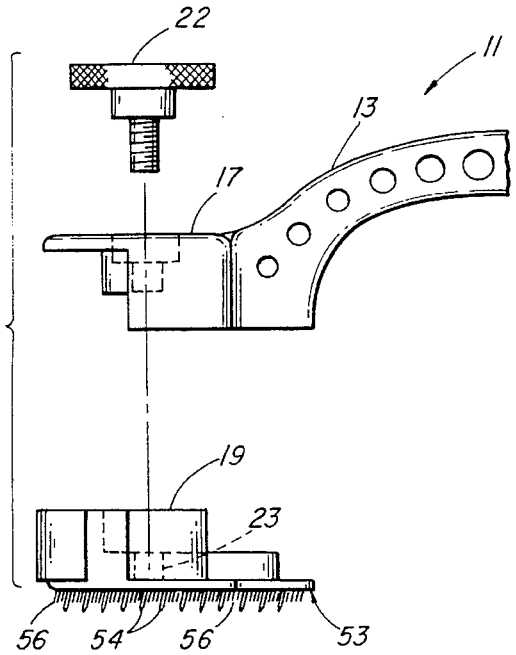
FIG. 9 is a fragmentary, side elevational assembly drawing of a kicker head and a face plate for carpet installation.
Figure 10:
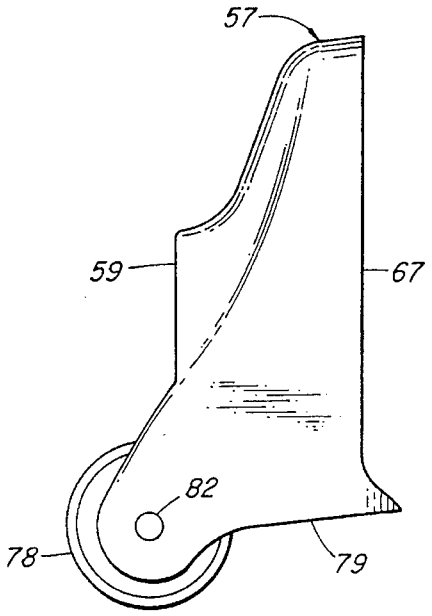
FIG. 10 is a side elevational view of an adapter plate.
Figure 11:
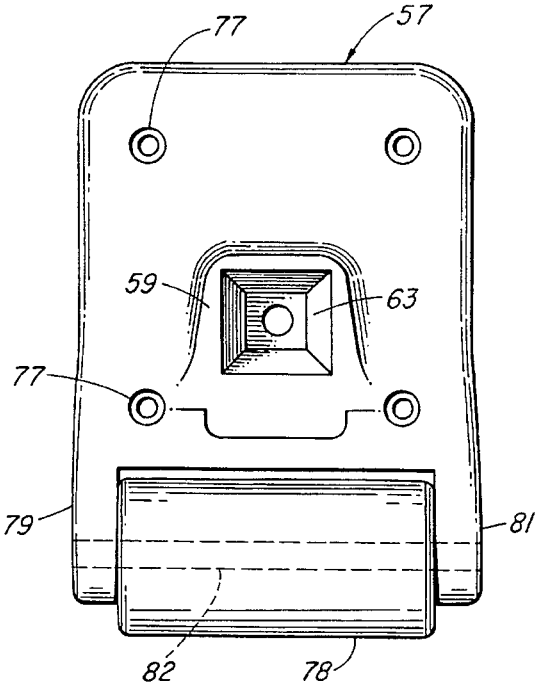
FIG. 11 is a front elevational view of the plate of FIG. 10.
Figure 12:
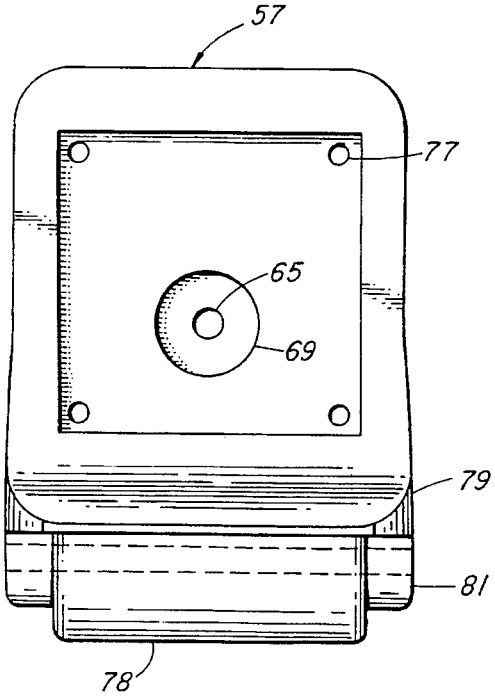
FIG. 12 is a rear elevational view of the plate of FIG. 10.
Figure 13:
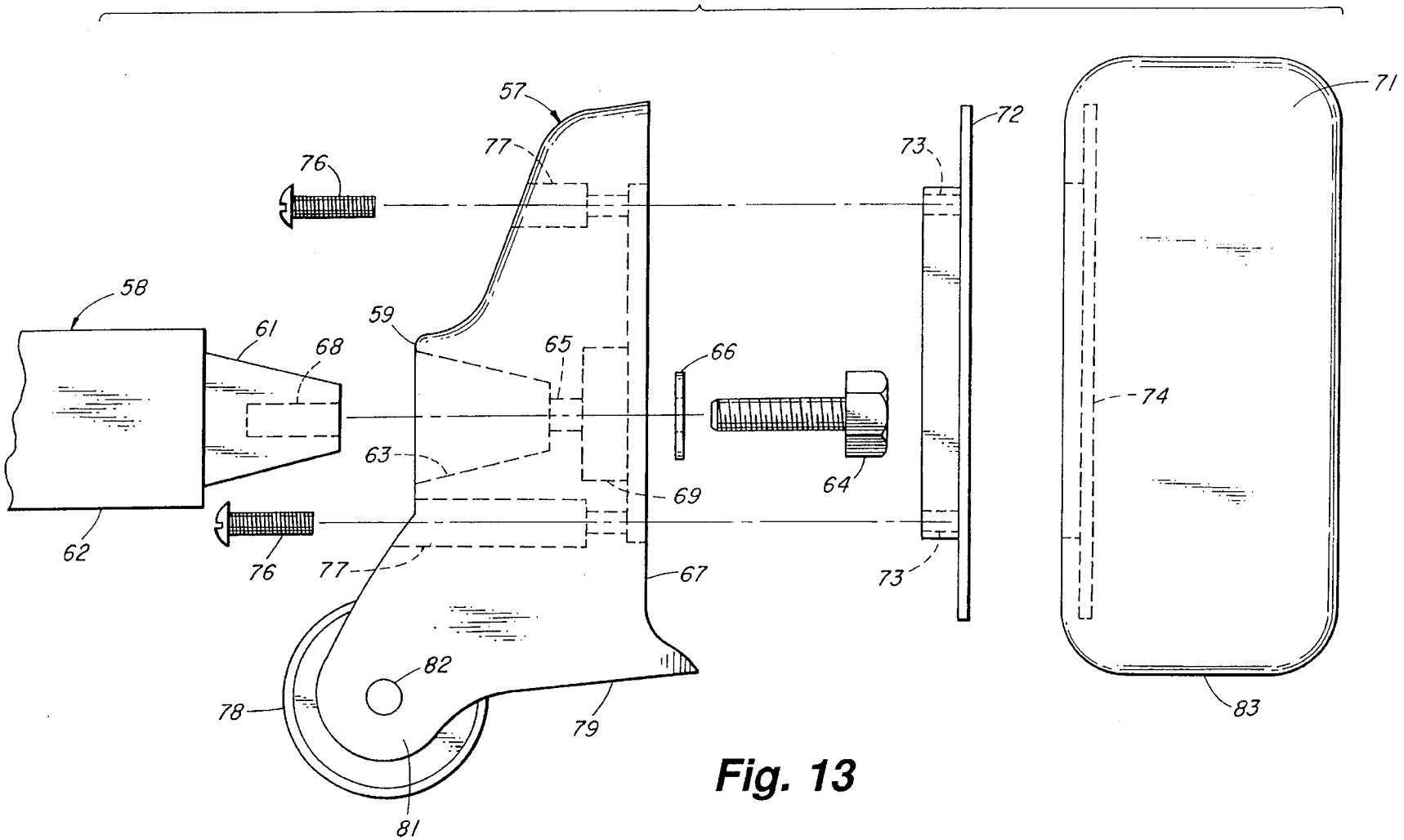
FIG. 13 is a fragmentary, side elevational assembly view, taken to an enlarged scale, showing a portion of a kicker shank, the adapter plate, and a knee pad.

The kicker 11 of the present invention may also be quickly converted for use as a carpet kicker. Making particular reference to FIG. 9, a carpet face plate 53, is disclosed. Face plate 53 includes a base 19, identical to that discussed above, for detachable engagement with kicker head and screw 22. However, rather than being fitted with a rubber boot as with the other face plates, face plate 53 includes a plurality of downwardly and forwardly inclined large spikes 54 and small rods 56, of conventional design. These spikes and rods are adapted effectively to engage the surface of carpet, so that butting forces applied on the knee pad 28, will translate the carpet into proper position.

Wheel 36 provides the same advantages for the kicker 11, when it is converted for installing carpet. Maintaining the lower edge 39 of the knee pad in spaced relation above the carpet, the wheel provides lowered resistance to the butting forces, applied by the installer. This lowered resistance is particularly significant where the carpet is thick, and would otherwise impede the efforts of the installer.

Another aspect of the invention includes structures for modifying prior art kickers, to enjoy the advantages of the teachings herein. FIGS. 10–13 disclose the first of these structures, an adapter plate 57, for use with a kicker 58 of conventional design. Adapter plate 57 has a forward portion 59 adapted to receive a rearward end 61 of kicker shank 62. Forward portion 59 includes pyramidal recess 63, sized and configured to accommodate end 61. Bolt 64 passes through a washer 66 and a bore 65, to screw into internal threads 68, within end 61. A rearward portion 67 of plate 57 includes a round hole 69, for housing the head of bolt 64 and the washer 66.

Knee pad 71 includes a base plate 72, having four internally threaded holes 73 therein. Base plate 72 fits snugly within a cavity 74, in the forward face of pad 71. To install the knee pad to the adapter plate, four screws 76 are passed through shouldered bores 77, and then threaded into holes 73. Depending upon the particular design of the prior art kicker, the existing base plate may be usable directly with adapter plate 57, or a new base plate, such as that shown in FIG. 13, may be required. In any event, the existing prior art shank, knee pad, and head should be usable in constructing the modified kicker, making the conversion economical and easy to complete.

A wheel or roller 78, is rotatably mounted to a lower portion 79, of adapter plate 57. For that purpose, a pair of lugs 81 depends from portion 79, and an axle 82 is secured between the lugs, journaled freely through the center axis of wheel 78. The dimensions of the assembly of the lugs and the wheel are such as to maintain a lower edge 83 of the knee pad in spaced relation from the floor surface. Thus, for the prior art kicker, the adapter plate provides the two advantages of eliminating friction between the knee pad and the floor, and supporting the rear end of kicker by a rotatably mounted wheel presenting low resistance to forward movement. Also, when used on vinyl flooring, the modified prior art kicker will not mar or scuff the vinyl floor covering.

Figure 14:
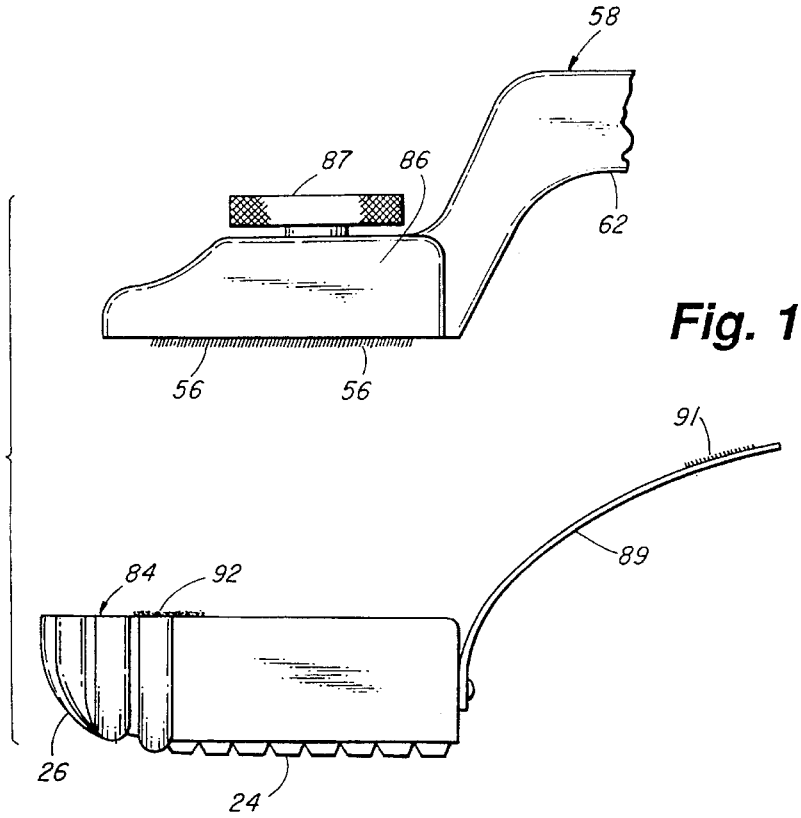
FIG. 14 is a fragmentary, side elevational assembly drawing of a prior art kicker head and an adapter boot for vinyl floor installation.

However, a further adapter is required to allow a prior art kicker to be used on vinyl flooring. This structure, a boot adapter 84, is disclosed in FIGS. 14–16. The kicker head 86 of the prior art device, typically has an adjustment knob 87 and an internal mechanism, effective to adjust the height of the spikes 54 (not evident in FIG. 14), in accordance with the characteristics of the carpet to be installed. In the fully withdrawn position, shown in FIG. 14, only the short rods 56 are still protruding.

Figure 15:
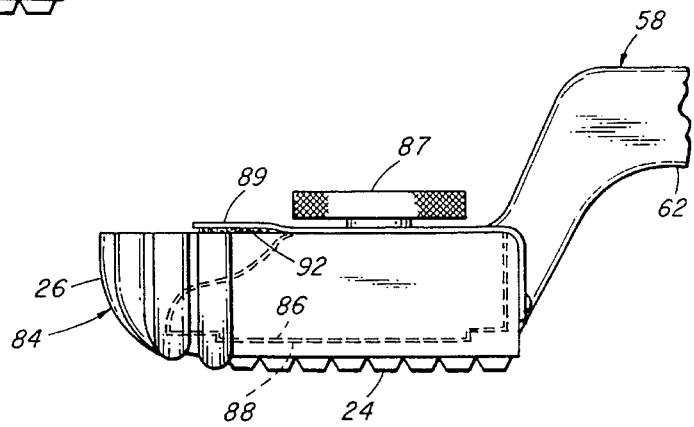
FIG. 15 is a side elevational view of the prior art kicker head fitted with the adapter boot; and, FIG. 16 is a top plan view of the head and adapter shown in FIG. 15.
Figure 16:
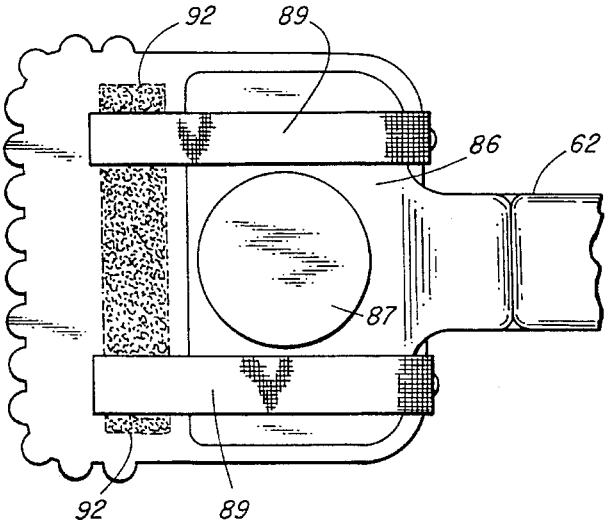

The boot adapter 84 includes a well 88, sized and configured to conform to corresponding portions of the head so that the boot is readily slipped over the head (see, FIG. 15). A pair of straps 89, is rivet attached to the rear wall of adapter 84. The underside of the forward end of each strap has a VELCRO hook strip 91, affixed thereto. A corresponding VELCRO pile strip 92, is transversely affixed to the upper side of boot adapter 84. Once the boot is fitted to the kicker head, the straps are simply looped over the top of the kicker head, and attached to the strip 92 (see, FIG. 16).

Adapter boot 84 also includes knobs 24 on its downwardly directed face, as-with the face plates 18 and 42. And, although the adapter boot shown in the drawings has an upwardly and forwardly directed nose 26 for installing coving, it will be appreciated that a separate boot can also be provided, having a nose portion which corresponds to that disclosed previously, in FIG. 6. In that way, the installer will have the flexibility and efficiency of two adapter boots, one designed for installing coving and the other specially adapted for flat lay installation.

It will be appreciated, then, that I have disclosed an improved kicker for the installation of both carpet and vinyl floor coverings, and a method for using same.

What is claimed is:

1. An apparatus for installing floor covering, comprising:

a. an elongated body, having a forward portion and a rearward portion, and a shank therebetween;

b. a head on the forward portion of said body, said head having a downwardly directed face, adapted to engage the floor covering;

c. a knee pad on the rearward portion of said body;

d. a wheel;

e. a bracket having an upper end and a lower end, said upper end being attached to said body, and said wheel being rotatably mounted to said lower end, said bracket and said wheel maintaining a lower edge of said knee pad in spaced relation from the floor.

2. An apparatus as in claim 1 in which said face of said head comprises a rubber boot, having a plurality of knobs protruding therefrom.

3. An apparatus as in claim 2 in which said head includes means for detachably mounting said boot thereto.

4. An apparatus as in claim 3 in which said detachable mounting means includes a base plate, said boot being attached to an underside of said base, and further including a screw passing through said head, engaging threads in said base plate.

5. An apparatus as in claim 2 in which said knobs are pyramidal in configuration, having a substantially flat downwardly facing surface and upwardly diverging sidewalls.

6. An apparatus as in claim 1 in which said head includes at least two face plates, a first plate having a downwardly directed surface adapted to engage carpet, and a second plate having a downwardly directed surface adapted to engage vinyl floor covering, and further including means for detachably mounting said plates to said head in selective, alternating fashion, corresponding to the carpet or vinyl floor covering to be installed.

7. An apparatus as in claim 1 in which said face of said head comprises a face plate, having a plurality of spikes projecting therefrom, said spikes being downwardly and forwardly directed.

8. An apparatus as in claim 1 including an axle journaled through said wheel, said axle being supported at its ends by said bracket.

9. An apparatus as in claim 1 in which said bracket is attached to said shank, just forwardly from said knee pad.

10. An adapter for a knee kicker for installing floor covering, the knee kicker having an elongated shank, a head attached to a forward end of the shank, and a knee pad having a base, detachably fixed to a rearward end of the shank, comprising:

a. an adapter plate having a forward portion adapted to receive the rearward end of the shank, and a rearward portion attached to the base of the knee pad;

b. a wheel, rotatably mounted to a lower portion of said adapter plate, for maintaining a lower edge of the knee pad in spaced relation from the floor, providing rolling support for the knee kicker.

11. An apparatus as in claim 10 in which said wheel is rotatably mounted to said adapter plate by means of a horizontally oriented axle.

12. An apparatus as in claim 10 including screws to attach said adapter plate to said base.

13. An apparatus as in claim 10 in which said adapter and said base, respectively, have rearward and forward mating surfaces of substantially identical elevational configurations.

14. An apparatus as in claim 10 in which said adapter plate has an aperture therein, sized and configured for receiving said shank, and further including means for detachably affixing said shank within said aperture.

15. An apparatus for installing floor covering, comprising:

a. an elongated body, having a forward portion and a rearward portion;

b. head means on the forward portion of said body, said head means having a downwardly facing surface, for engaging the floor covering;

c. a knee pad on the rearward portion of said body;

d. a wheel;

e. bracket means for rotatably mounting said wheel beneath said body forwardly from said knee pad, said bracket and wheel maintaining a lower edge of said knee pad in spaced relation from the floor.

16. An apparatus as in claim 15 in which said downwardly facing surface has a plurality of protruding knobs, and in which said head means further has a forwardly and downwardly directed nose.

17. An adapter for a knee kicker for installing carpet, the knee kicker having an elongated shank, a head attached to a forward end of the shank, the head having a bottom portion with downwardly protruding rods for engaging the carpet, a top portion, a forward portion, a rear portion, and side portions, and a knee pad fixed to a rearward end of the shank, comprising:

a. an adapter boot made of a resilient, rubber material, said boot being sized and configured to cover at least said bottom portion of said head including the protruding rods; and, b. means for detachably affixing said adapter boot into locking engagement over said bottom portion of said head, preventing the protruding rods from engaging a floor covering during use of the kicker.

18. An adapter as in claim 17 in which said boot further includes a well therein, said well being sized and configured substantially to enclose said bottom, side, front, and rear portions of said head.

19. An adapter as in claim 17 in which said means for detachably affixing includes at least one strap, one end of said strap being attached to a rear end of said boot, and an underside of the other end of said strap including a strip of material having hooks thereon, and further including a strip of pile material on an upper surface of a front end of said boot, said pile being selectively engaged by said hooks when said strap is looped over a top portion of said head.

20. An adapter as in claim 19 including a pair of said straps, and in which said strip of pile extends across said boot, for engagement by hooks on a respective strap.

21. An adapter as in claim 17 in which said boot has a downwardly directed face with a plurality of protruding knobs on said face, and in which said boot further has a forwardly and downwardly directed nose.

22. A method for using a knee kicker for installing floor covering, the knee kicker having an elongated shank, a head attached to a forward end of the shank, and a knee pad having a base, attached to a rearward end of the shank, the method comprising:

a. maintaining the head in engaged relation with the floor covering;

b. butting the knee pad forwardly, to urge the floor covering forwardly; and, c. maintaining a lower edge of the knee pad in spaced relation above the floor covering while butting the knee pad, said step of maintaining a lower edge being carried out using a bracket attached to the shank, while a lower portion of said bracket rotatably supports a floor engaging wheel.

23. A method as in claim 22 in which the knee pad has a base which is detachably affixed to the rearward end of the shank, and in which the step of maintaining a lower edge of the knee pad in spaced relation above the floor covering is carried out using an adapter plate having a forward portion attached to the rearward end of the shank, a rearward portion attached to the base, and a lower portion which rotatably supports a floor engaging wheel.

24. An adapter for a knee kicker for installing carpet, the knee kicker having an elongated shank, a head attached to a forward end of the shank, the head having a bottom portion, a top portion, a forward portion, a rear portion, and side portions, and a knee pad fixed to a rearward end of the shank, comprising:

a. an adapter boot made of a resilient, rubber material, said boot being sized and configured to cover at least said bottom portion of said head; and, b. means for detachably affixing said adapter boot over said bottom portion of said head, said means including at least one strap, one end of said strap being attached to a rear end of said boot, and an underside of the other end of said strap including a strip of material having hooks thereon, and further including a strip of pile material on an upper surface of a front end of said boot, said pile being selectively engaged by said hooks when said strap is looped over a top portion of said head.

25. An adapter as in claim 24 including a pair of said straps, and in which said strip of pile extends across said boot, for engagement by hooks on a respective strap.

26. An adapter as in claim 24 in which said boot has a downwardly directed face with a plurality of knobs on said face, and in which said boot further has a forwardly and upwardly directed nose.

* * * * *